US006439186B1

(12) United States Patent
Owen et al.

(10) Patent No.: US 6,439,186 B1
(45) Date of Patent: Aug. 27, 2002

(54) MECHANICAL OIL FILTRATION IN AN I.C. ENGINE VALVE LIFTER

(75) Inventors: Nathan B. Owen, Holly; Ralph Lyle Clayson, III, Grand Rapids, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 16 days.

(21) Appl. No.: 09/783,697

(22) Filed: Feb. 14, 2001

(51) Int. Cl.[7] ..... F01L 1/245
(52) U.S. Cl. ..... 123/90.55; 123/90.49
(58) Field of Search ..... 123/90.48, 90.49, 123/90.5, 90.55

(56) References Cited

U.S. PATENT DOCUMENTS 4,584,976 A * 4/1986 Hillebrand ..... 123/90.55
4,840,153 A * 6/1989 Aida et al. ..... 123/90.55
4,920,935 A * 5/1990 Shida ..... 123/90.51
5,934,232 A * 8/1999 Greene et al. ..... 123/90.16
5,979,377 A * 11/1999 Barth et al. ..... 123/90.12

* cited by examiner

*Primary Examiner*—Wellun Lo
(74) *Attorney, Agent, or Firm*—John Van Ophem

(57) ABSTRACT

A mechanical oil filtration and oil flow re-direction system for a hydraulically actuated valve lifter. Pressurized oil is directed to the lifter through a series of controlled clearance passages prior to gaining access to the internal cavity of the lifter. Once inside the lifter, the oil is deflected off of an insert that directs the oil towards the upper end of the lifter and the push rod seat. The oil flow is then directed downwards into an oil deflector supply hole and into the internal cavity of the lifter and the chamber containing the lifter check ball and seat. In use, the system restricts particulates from the lifter, and re-directs particulates that do access the lifter to pre-determined locations within the lifter to minimize operational impairment of the lifter from particulate contamination.

9 Claims, 4 Drawing Sheets

MECHANICAL OIL FILTRATION IN AN I.C. ENGINE VALVE LIFTER

BACKGRONUD OF THE INVENTION

1) Field of the Invention

The invention generally relates to the field of hydraulically actuated valve lifters for internal combustion ("I.C.") engines. More particularly, the invention relates to an improved valve lifter body and internal lifter apparatus configuration which restricts particulate contaminants contained in the oil from entering the lifter internal mechanism and fouling lifter operation.

2) Description of the Related Art

In the I.C. engine field, there exists a continuing pursuit of reliability in engine operation. An ongoing problem related to reliability is engine component failures related to lubrication interruptions and blockages. In the field of valve lifters, which actuate valves either directly or through related valve train components, a constant supply of fresh filtered oil is necessary for reliable long-term operation. As shown in FIG. 1, pressurized oil from the I.C. engine oil pump is supplied via oil passages (galleries) 1 which communicate with the circumferential groove around the outside of the lifter assembly 2. The oil enters the lifter body via oil ports 3 located on the side of the lifter assembly 2. Oil enters the hollow plunger through one or more oil inlet holes 4 to the plunger cavity to form an oil column.

The lifter consists of a "plunger" closely fitted into, but freely slideable, within a "body" with a lower chamber left between the plunger and body. The bottom of the plunger is fitted with a check valve that allows free flow downward into the lower chamber but prevents reverse flow upward out of it.

During engine operation the cam lobe rotates and forces the lifter upward against the opposing force of the valve spring to open the engine valve. During the valve opening event, a controlled leakage between the plunger and body corresponds to a downward plunger movement that gives the hydraulic lifter its automatic adjustment ability. At the completion of the valve closing event, the valve returns to the fully closed position, the lifter is again on the base circle of the cam and a small amount of lash has therefore accumulated in the valve train.

At this point upon completing a valve lift event, the lifter spring, assisted somewhat by engine oil pressure, pushes the plunger upward to remove all accumulated lash from the valve train. As the plunger moves upward sufficient oil is sucked down through the ball check valve 5 to solidly fill the lower chamber. As the engine continues to rotate, the cam lobe again forces the lifter upwards to open the engine valve and oil in the lower chamber is sealed by action of the check ball which closes almost instantly.

To operate properly, the lifter must receive adequate amounts of clean oil, otherwise free movement of the plunger or the ball check valve seating/sealing will be affected. Dirt/debris particulate matter will cause improper operation of the lifter resulting in valve train noise or ultimately lead to permanent engine failure. In the case where the particulate debris has gained access to the lifter interior cavity, the particulates can impair operation of the lifter check valve 5 located therein by interposing between the ball and valve seat 6. If this condition were to occur, the ball fails to seat thereby allowing oil to flow back from the lower chamber to the plunger chamber. Additional failure can occur with debris becoming lodged between the plunger and body thereby restricting free movement. These failures result in loss of hydraulic function with resultant valve train noise and customer dissatisfaction. These types of failure account for 3–5% of all valve train related warranty returns.

Particulates contained in the oil of an I.C. engine have several sources. One source is from debris contained within the engine from machining and manufacture and/or repair. Another is from accumulations resulting from engine operation. These sources are routinely dealt with through oil filtration; however, oil is sometimes supplied throughout the engine during start up without filtration because the engine oil filter is in a full load bypass mode. As a result, particulates are passed throughout the engine including the valve lifters. Mesh filtration systems to address this problem would lead to clogging and an unserviceable oil blockage condition.

SUMMARY OF THE INVENTION

This invention is directed to a mechanical oil filtration and redirecting system to control the access and passage of particulates in and through the valve lifter. The object of the invention system is to filter (limit access) large particulates and to redirect or deflect the smaller particulates which do access the lifter to-pre-determined locations where little or no operational impairment can occur.

The invention is a valve lifter incorporating exteriorly and interiorly located structure that limits initial particulate access to the lifter, and re-directs particulates in the oil which do pass through to the valve lifter so as to prevent operational impairment of the lifter caused by the particulates.

Access of particulates to the lifter is initially limited by a controlled gap located between the lifter body and the lifter bore in the surrounding I.C. engine. Following this controlled gap, a second controlled gap exists inside the lifter between the inside of the lifter valve body and the lifter plunger. Once the oil is passed through the first two controlled gap limitations, the oil, at this point containing only smaller particulates, is deflected by an insert located within the lifter internal cavity upwardly towards the push rod seat (valve train actuation portion of the lifter) and oil metering valve. The mechanically filtered oil is then directed towards the oil supply hole located in the upper portion of the deflector and thereafter into the low pressure side of the plunger cavity which includes, at its lower end, the lifter check valve.

In addition to providing the final structural elements for mechanical oil filtration, the oil-deflecting insert also traps the oil within the lifter above the height of the plunger oil feed hole. This containment of the oil results in a retained oil column within the lifter cavity having greater height and therefor less oil fill requirement at engine start up to initiate proper lifter operation.

DETAILED DESCRIPTION OF THE INVENTION

Figure 1:
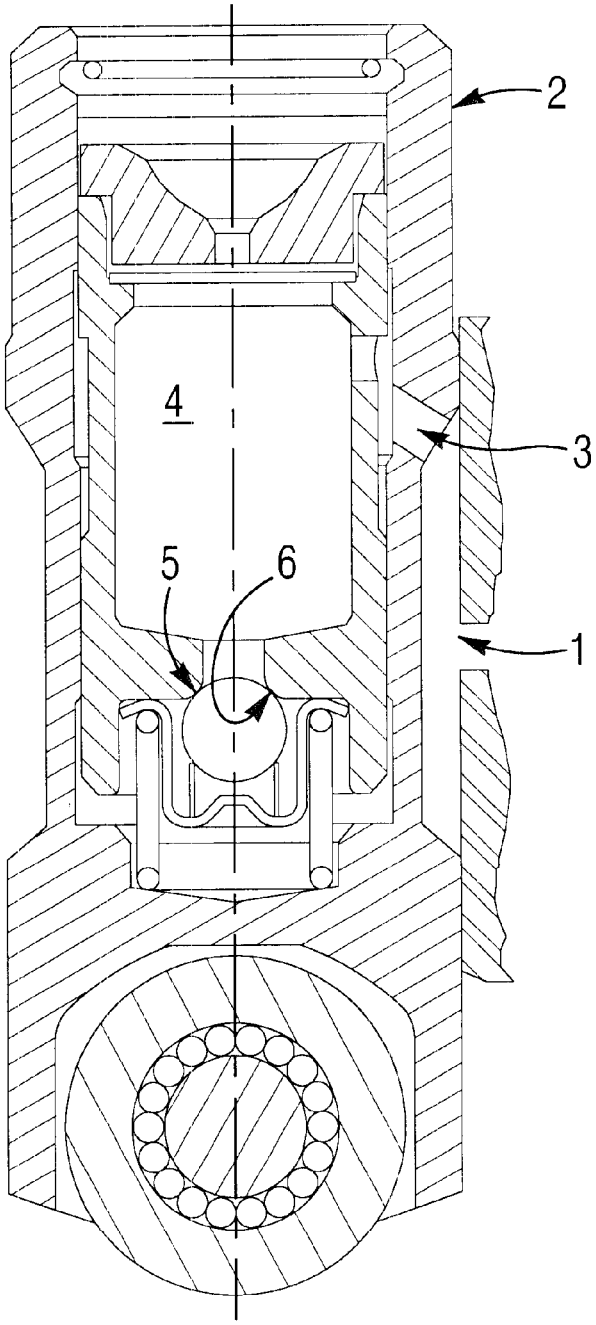
PRIOR ART FIG. 1
FIG. 1: is a partial sectional view of a conventional prior art valve lifter showing I.C. engine oil galleries and unrestricted passageways within the lifter.
Figure 2:
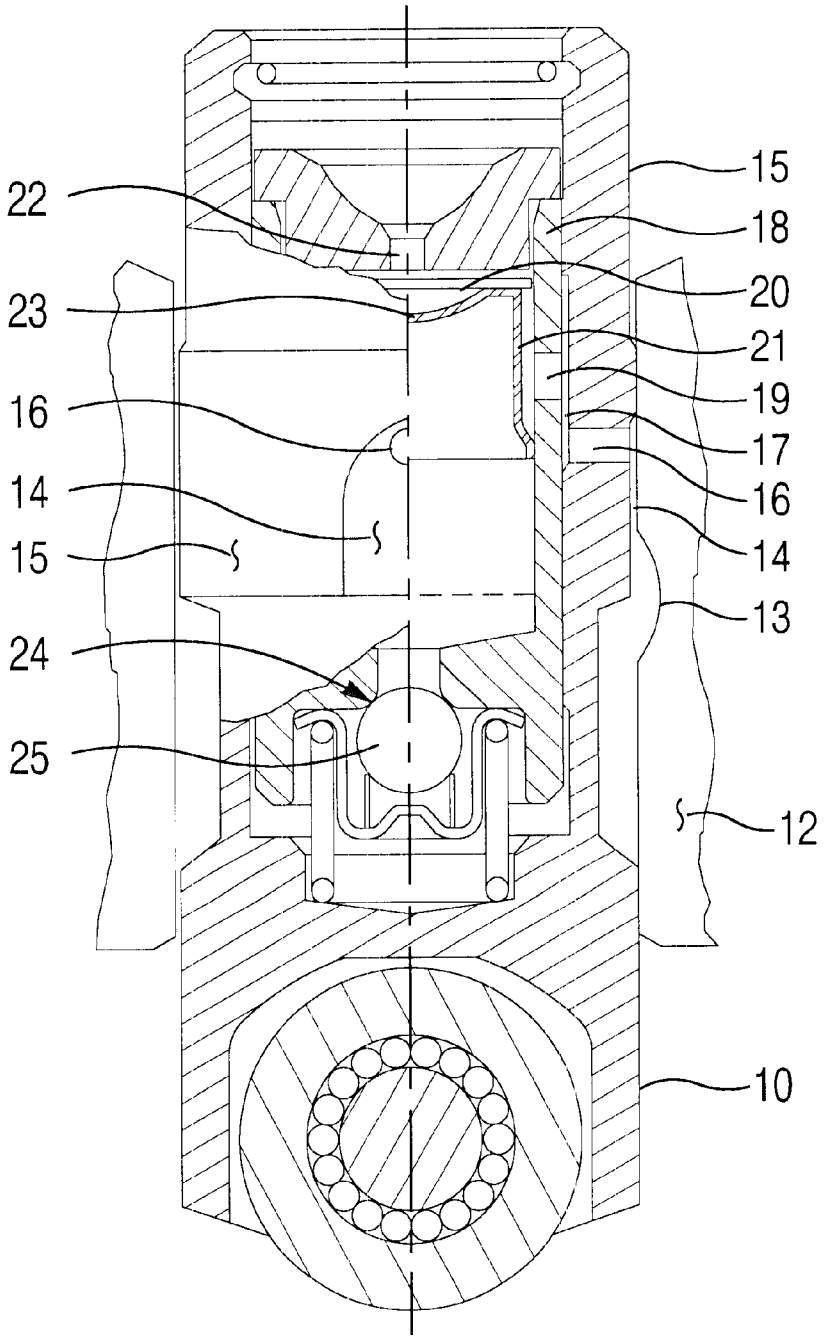
FIG. 2: is a partial sectional view of a valve lifter according to the present invention showing the first and second controlled clearances and oil deflecting insert of the present invention.

In FIG. 2, the hydraulic valve lifter 10 is contained within the lifter bore 12 of the surrounding I.C. engine structure and is supplied with engine oil from the oil gallery through an orifice 13. Large particulates that may be part of the oil feed are restricted from entering a controlled clearance 14 between the valve lifter body 15 and the lifter bore 12. Smaller particulates that remain a part of the oil flow would continue into the lifter body oil hole 16. A second controlled clearance 17 between the valve lifter body 15 and the valve lifter plunger 18 would restrict the next size of particulates from entering the plunger hole 19. The oil flow would be directed upwards towards the metering valve 20 by the oil deflector insert 21 that supports the metering valve directing any remaining particulates towards the push rod seat oil hole 22. The mechanically filtered oil would then deflect off of the metering valve and proceed downwards into the oil deflector supply hole 23 to fill the low pressure side of the plunger cavity. This oil flow path resulting from the various constrictions and deflections minimizes the likelihood of any significant particulates becoming trapped between the check ball seat 24 and the check ball 25.

In the foregoing design, the restrictive passage 14 between the lifter bore 12 and oil feed hole 16 will tend to prevent large particulate matter from entering the lifter. This first restrictive passage 14 can be sized in the range of 0.7–0.9 mm. Using the upward camshaft induced motion and the downward valve spring induced motion, most particulates will be reduced in size before potentially entering the lifter body itself by normal oil pressure and flow. The oil then passes in the second controlled clearance 17 that again, owing to the respective movement of the plunger and the lifter body, reduces and limits particulate size. This second controlled clearance 17 can be sized in the range of 0.35–0.45 mm. Following entry into the lifter, the internal deflector or baffle 21 directs the contained particulates generally in an upward direction in the lifter towards the push rod seat area and away from the oil feed into the low pressure size of the plunger 18. In this way, particulates are directed away from the zone in the lifter where potentially the most harm to operation could occur, namely in the check valve 25 and seat 24 zone in the lower portion of the plunger 18.

The internal deflector or baffle 21 is sealingly engaged within the plunger 18 inner surfaces so as to contain and direct oil entering the plunger through the passageway 19 upwardly away from the lower portions of the plunger cavity. The smaller particulates still contained in the oil will tend to pass out of the lifter through the push rod seat hole 22. The baffle 21 can be configured in a variety of shapes to accomplish these design objectives and itself is gapped to the surrounding plunger surfaces by a gap in the range of 0.35–0.45 mm. and directs oil upwardly therethrough.

The baffle shown in FIG. 2 has an annular shape and is made from a moldable material having suitable wear, durability, and sealing characteristics for use in an I.C. engine oiling environment. Such materials are well known and include treated polymers and elastomers and composite constructed deflectors that include reinforcement so as to maintain shape and position in use. The partial plunger chamber height deflector shown in FIG. 2 would tend to remain in position owing to the positive pressure generated within the plunger during compression strokes of the lifter upon camshaft actuation.

Figure 3:
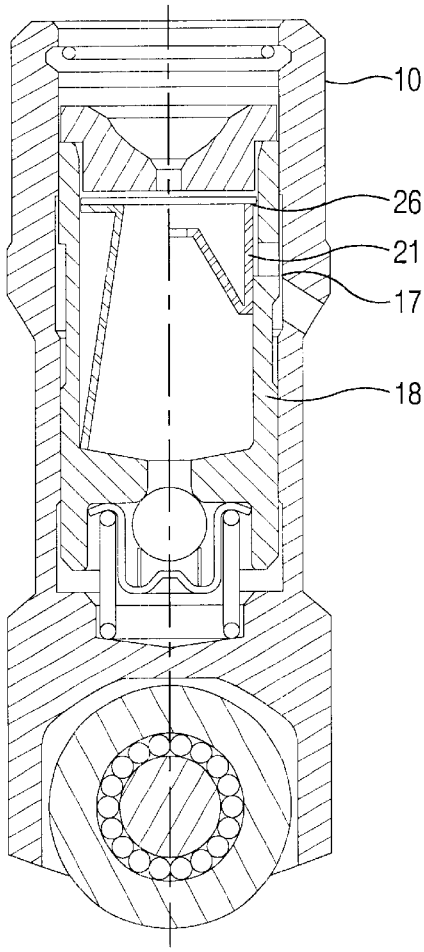
FIG. 3: is a partial sectional view of another embodiment of a lifter according to the present invention.
Figure 5:
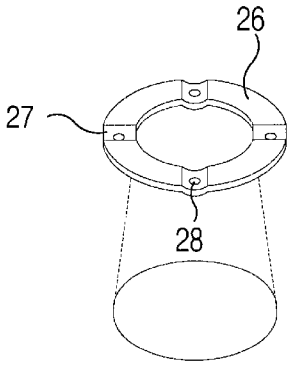
FIG. 5: is an oblique top view of another embodiment of an oil deflecting insert rim according to the present invention.
Figure 6:
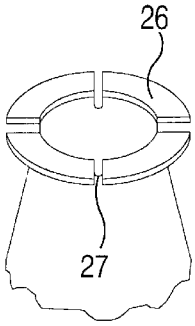
FIG. 6: is an oblique top view of another embodiment of an oil deflecting insert rim according to the present invention.

The internal baffle shown in the embodiment of the invention in FIG. 3 is a full chamber height skirted deflector 21 including an additional annular support element 26. This support element can have a variety of configurations to support and maintain the position of the deflector 21 inside the plunger 18. Various configurations for the support element 26 are shown in FIGS. 4, 5, and 6.

Figure 4:
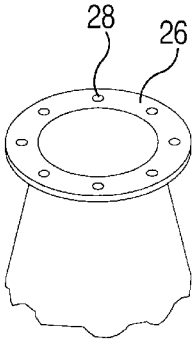
FIG. 4: is an oblique top view of an oil deflecting insert rim according to one aspect of the present invention.

In FIG. 4, the support element 26 includes oil passageways 28 for oil to pass upwardly through the rim of the defector 21 towards the push rod oil seat. From this upward location, the de-particulated oil can drain downwardly through the oil deflector supply hole 23. Another variation of the support plate is shown in FIG. 5 wherein the support 26 includes combination slots 27 and oil passages 28. The slots provide for expansion and contraction of the support plate as it maintains position within the plunger body cavity. Likewise, the configuration of the support plate shown in FIG. 6 includes extended slots 27 with the segments of the support ring 26 connected by a spring wire element.

Figure 7:
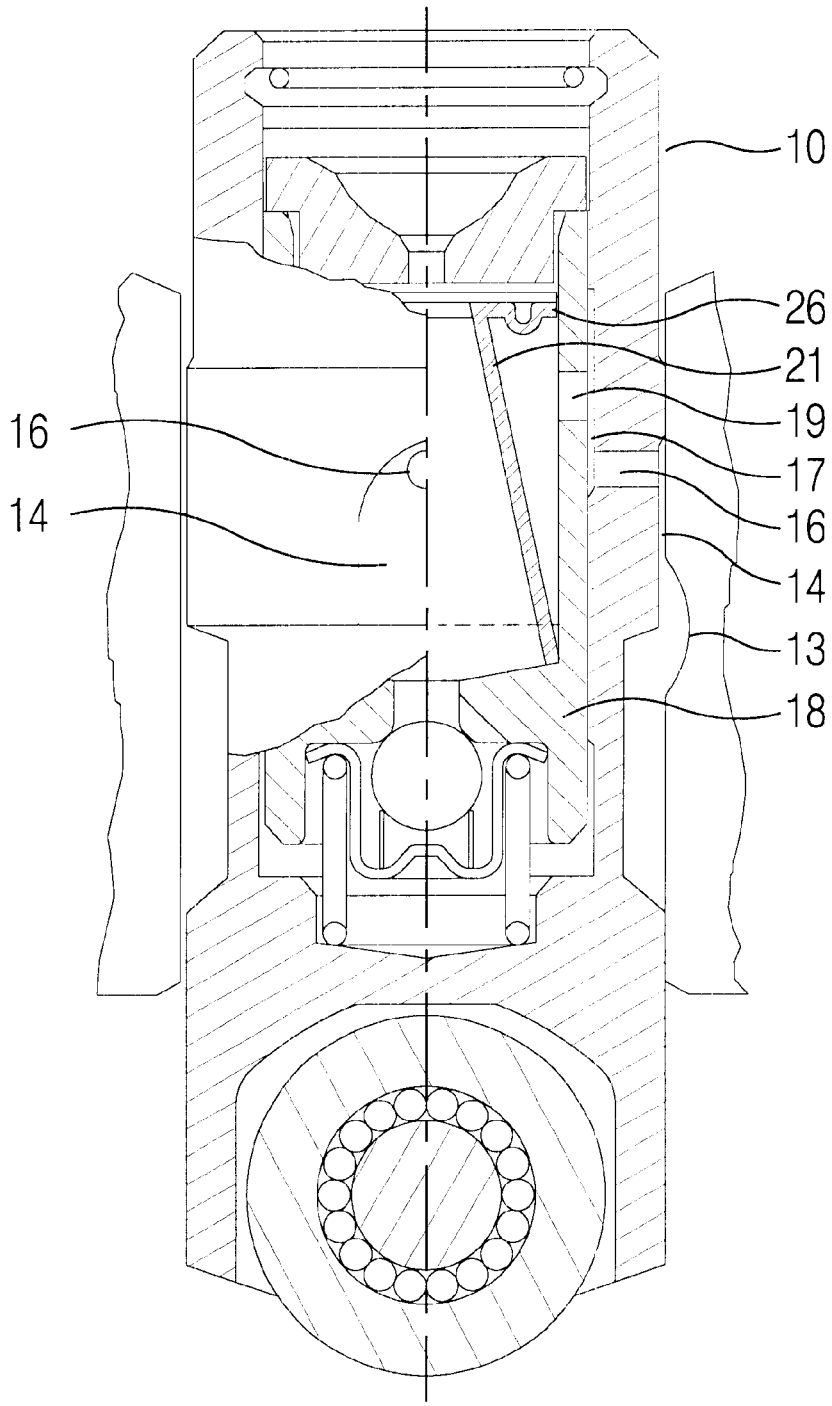
FIG. 7: is a partial sectional view of a valve lifter including the mechanical oil filtration system and structure of the present invention.

The embodiment of the invention shown in FIG. 7 includes a fully skirted deflector 21 with a support plate 26 including a radially oriented trough to enable the support 26 to maintain position within the plunger 18 chamber.

The invention has been described as having three elements to accomplish the filtration and deflector objectives of the system. The first element is the controlled gap 14 between the lifter external body surface and the internal surfaces of the lifter bore. The second element is the controlled gap 17 between the plunger body and the lifter plunger 18. The third element is the internal baffle deflector itself 21, which can have a variety of shapes and/or support elements 26. These various elements can be used in various combinations to effect certain goals of the invention. Using only the first two elements in conjunction will result in a mechanical destruction and reduction of the particulates entering the lifter. Likewise, if the third element is used exclusive of the other elements, excessive particulates may collect within the deflector. Hence, while certain progress can be made towards the objectives of the invention when the elements are used in single combination, a preferred result is obtained when the three elements are used in conjunction.

In addition to the foregoing filtration system, the deflector 21 has the additional feature of trapping oil within the plunger cavity, and maintaining the column height of the oil higher than the location of the plunger oil hole 19. This is particularly an advantage when the lifter is used at an incline (i.e., in V-shaped I.C. engine configurations, or slanted inline engine configurations). The retained oil within the lifter requires less fill time upon initial engine start up and results in quieter engine operation sooner than without the baffle/deflector 21 in place.

What is claimed is:

1. A hydraulically actuated valve lifter, said lifter comprising:

a body having a first oil flow passageway through a wall thereof and accessing a first internal cavity defined within said lifter body;

a valve lifter plunger contained for reciprocal movement within said first internal cavity, said plunger including walls and having a second oil flow passageway extending through said plunger walls into a second internal cavity defined within said plunger, a constricted oil flow passageway defined between an external surface of said lifter plunger and an internal surface of said lifter body, said constricted passageway connecting between said first oil flow passageway and said second oil flow passageway, and, an oil deflector insert contained within said second internal cavity, said oil deflector including an upper portion sealingly engaged to inner surfaces of said plunger to direct oil within said plunger towards an upper end of said plunger, said upper portion further including an oil supply hole for enabling oil to pass into a lower portion of said plunger and into a lower portion of said second internal cavity.

2. A valve lifter as in claim 1, wherein said constricted oil flow passageway is sized to have a maximum dimension in the range of 0.35–0.45mm.

3. A valve lifter as in claim 2, wherein: said upper portion of said oil deflector has an annular shape and said oil supply holes are coincident with depressions in an upper surface of said annular shape.

4. An valve lifter system as in claim 2, wherein: said upper portion of said oil deflector has an annular shape and said oil supply holes are gaps in said annular shape.

5. An oil filtration system in a hydraulically actuated valve lifter in an internal combustion (I.C.) engine, said lifter including a body having a first oil flow passageway through a wall thereof and accessing a first internal cavity defined within said lifter body, and a valve lifter plunger contained for reciprocal movement within said first internal cavity, said plunger including walls and having a second oil flow passageway extending through said plunger walls into a second internal cavity defined within said plunger, said filtration system comprising:

a first constricted oil flow passageway defined between an external surface of said valve lifter body and a valve lifter bore surrounding and operationally containing said lifter body for reciprocation in said I.C. engine, said first constricted passageway connecting between an oil supply gallery of said I.C. engine and said first oil flow passageway in said lifter body;

a second constricted oil flow passageway defined between an external surface of said lifter plunger and an internal surface of said lifter body, said second constricted passageway connecting between said first oil flow passageway and said second oil flow passageway; and, an oil deflector insert contained within said second internal cavity, said oil deflector including an upper portion sealingly engaged to inner surfaces of said plunger to direct oil within said plunger towards an upper end of said plunger, said upper portion further including an oil supply hole for enabling oil to pass into a lower portion of said plunger and into a lower portion of said second internal cavity.

6. An oil filtration system as in claim 5, wherein: said first constricted oil flow passageway is sized to have a maximum dimension in the range of 0.7–0.9 mm.

7. An oil filtration system as in claim 5, wherein said second constricted oil flow passageway is sized to have a maximum dimension in the range of 0.35–0.45 mm.

8. An oil filtration system as in claim 5, wherein: said upper portion of said oil deflector has an annular shape and said oil supply holes are coincident with depressions in an upper surface of said annular shape.

9. An oil filtration system as in claim 5, wherein: said upper portion of said oil deflector has an annular shape and said oil supply holes are gaps in said annular shape.

* * * * *